US009115874B2

(12) United States Patent
Kim et al.

(10) Patent No.: US 9,115,874 B2
(45) Date of Patent: Aug. 25, 2015

(54) OPTICAL SEMICONDUCTOR ILLUMINATING APPARATUS

(71) Applicant: POSCO LED COMPANY LTD., Seongnam-si (KR)

(72) Inventors: Seung Ki Kim, Seongnam-si (KR); Dong Soo Kim, Seongnam-si (KR); Tae Hoon Song, Seongnam-si (KR); Dong Hee Kim, Seongnam-si (KR); Su Woon Lee, Seongnam-si (KR); Il Park, Seongnam-si (KR)

(73) Assignee: Posco LED Company Ltd., Seongnam-si (KR)

( * ) Notice: Subject to any disclaimer, the term of this patent is extended or adjusted under 35 U.S.C. 154(b) by 163 days.

(21) Appl. No.: 13/921,526

(22) Filed: Jun. 19, 2013

(65) Prior Publication Data

US 2014/0036504 A1 Feb. 6, 2014

(30) Foreign Application Priority Data

Aug. 3, 2012 (KR) ..... 10-2012-0085250
Mar. 22, 2013 (KR) ..... 10-2013-0030813

(51) Int. Cl.

| | |
|---|---|
| ***F21V 29/00*** | (2015.01) |
| ***F21V 27/02*** | (2006.01) |
| ***F21K 99/00*** | (2010.01) |
| ***F21V 23/00*** | (2015.01) |
| ***F21V 29/75*** | (2015.01) |
| ***F21V 29/76*** | (2015.01) |
| *F21Y 101/02* | (2006.01) |

(52) U.S. Cl.

CPC ..... *F21V 29/002* (2013.01); *F21K 9/00* (2013.01); *F21V 23/006* (2013.01); *F21V 27/02* (2013.01); *F21V 29/75* (2015.01); *F21V 29/763* (2015.01); *F21K 9/30* (2013.01); *F21Y 2101/02* (2013.01)

(58) Field of Classification Search

USPC ..... 362/547, 218, 294, 373, 249.02, 362/311.02, 800, 545, 612, 97.3, 613, 611

See application file for complete search history.

(56) References Cited

U.S. PATENT DOCUMENTS

| | | | | |
|---|---|---|---|---|
| 7,470,921 | B2 * | 12/2008 | Custer | 250/504 R |
| 8,066,404 | B2 * | 11/2011 | Song et al. | 362/219 |
| 2002/0176250 | A1 * | 11/2002 | Bohler et al. | 362/236 |
| 2003/0156416 | A1 * | 8/2003 | Stopa et al. | 362/294 |
| 2008/0117647 | A1 * | 5/2008 | Behr et al. | 362/547 |
| 2009/0316405 | A1 * | 12/2009 | Lai | 362/249.01 |
| 2010/0061109 | A1 | 3/2010 | Hou et al. | |
| 2012/0140437 | A1 | 6/2012 | Kim et al. | |
| 2013/0094224 | A1 * | 4/2013 | Miyatake et al. | 362/363 |

FOREIGN PATENT DOCUMENTS

| | | |
|---|---|---|
| JP | 2008-059965 | 3/2008 |
| KR | 1020100073561 | 7/2010 |
| KR | 1020100100740 | 9/2010 |
| KR | 1020100137097 | 12/2010 |
| KR | 10-2011-0060476 | 6/2011 |
| KR | 10-1042947 | 6/2011 |
| KR | 10-2011-0091397 | 8/2011 |
| KR | 10-2012-0049576 | 5/2012 |

* cited by examiner

*Primary Examiner* — Laura Tso

(74) *Attorney, Agent, or Firm* — H.C. Park & Associates, PLC

(57) ABSTRACT

Embodiments of the invention provide an optical semiconductor illuminating apparatus, which includes a heat dissipating base; a light emitting module comprising at least one semiconductor light emitting device and mounted on a lower side of the heat dissipating base; and a plurality of heat dissipating fins each having opposite edges protruding from opposite sides of the heat dissipating base and being mounted on an upper surface of the heat dissipating base.

19 Claims, 11 Drawing Sheets

OPTICAL SEMICONDUCTOR ILLUMINATING APPARATUS

CROSS-REFERENCE TO RELATED APPLICATIONS

This application claims priority from and benefit of Korean Patent Application No. 10-2012-0085250, filed on Aug. 3, 2012, and Korean Patent Application No. 10-2013-0030813, filed on Mar. 22, 2013, which are hereby incorporated by reference for all purposes as if fully set forth herein.

BACKGROUND OF THE INVENTION

1. Field of the Invention

Embodiments of the invention relate to an optical semiconductor illuminating apparatus, and more particularly, to an optical semiconductor illuminating apparatus which permits various types of interconnection through a single module according to country and is capable of improving heat dissipation capabilities.

2. Discussion of the Background

Optical semiconductor devices such as light emitting diodes (LEDs) or laser diodes (LD) have attracted increasing attention due to advantages such as low power consumption, long lifespan, high durability, and excellent brightness, as compared with incandescent lamps or fluorescent lamps.

In addition, an illuminating apparatus based on such an optical semiconductor does not employ environmentally harmful materials such as mercury and is thus environmentally friendly.

In the related art, an optical semiconductor illuminating apparatus includes a plurality of light emitting modules to be suited for illuminating devices, such as street lamps, security lamps, and factory lamps, which are required to have high light output.

In such an optical semiconductor-based illuminating apparatus, each of the light emitting modules includes a light emitting section which emits light via operation of an LED, and a heat sink cooling the light emitting section and composed of a heat dissipating base and a plurality of heat dissipating fins.

The light emitting section is placed on one side of the heat dissipating base, and the plurality of heat dissipating fins are integrally formed at the other side thereof.

An illuminating apparatus employing such an optical semiconductor device as a light source generates large amounts of heat during operation of the light emitting modules which include optical semiconductor devices.

In addition, since the heat dissipating fins are formed only on a lower inner surface of the heat dissipating base, air flow passages between the heat dissipating fins are blocked by the heat dissipating base, thereby causing significant deterioration in heat dissipating efficiency of the light emitting module and the optical semiconductor illuminating apparatus including the same.

Although attempts have been made to secure air flow between the light emitting section and spaces between the heat dissipating fins by arranging the light emitting modules in a line to be separated from each other, this structure increases the volume of the illuminating apparatus, thereby making it difficult to obtain a compact structure, and causes an undesirable increase in distance between the light emitting sections, thereby deteriorating uniformity of illumination.

Moreover, this structure still provides a long passage for cold air to reach the heat dissipating fins, thereby providing a limited effect in improvement of heat dissipation efficiency.

Further, a conventional light emitting module has an external structure which cannot be applied to other illuminating apparatuses, and can be restrictively used only for associated illuminating apparatuses due to the absence of a drive circuit.

In recent years, although technology of integrating the drive circuit into the light emitting module has been suggested for the purpose of eliminating a switching mode power supply (SMPS), this technology has not been developed for general light emitting modules, and generalized light emitting modules are difficult to realize using only existing technologies known in the art.

Further, in such an illuminating apparatus, at least one light emitting module including a heat sink is assembled with a housing structure.

In the light emitting module, a printed circuit board (PCB) is placed on a front side of a heat sink having a plurality of heat dissipating fins formed on a rear side thereof, and light emitting devices each including an optical semiconductor are placed on the PCB.

However, the illuminating apparatus including such a light emitting module has a problem in that adaptations required to meet varying regulations between countries are difficult to realize.

Moreover, such an illuminating apparatus requires a predetermined heat transfer area to secure a certain degree of heat dissipation, thereby causing increase in volume and weight of the heat sink including the heat dissipating fins.

SUMMARY OF THE INVENTION

The present invention has been conceived to solve such problems in the related art.

One exemplary embodiment of the invention provides an optical semiconductor illuminating apparatus that permits various types of interconnection through a single module according to country and can improve heat dissipation capabilities and provide a sufficient space for mounting components while increasing a heat transfer area.

Another exemplary embodiment of the invention provides an optical semiconductor illuminating apparatus, which can secure air flow passages directly connecting a space, in which heat dissipating fins are placed, to a space, in which a light emitting module is placed, on a heat dissipating base.

A further exemplary embodiment of the invention provides an optical semiconductor illuminating apparatus, which can secure a plurality of air flow passages between a space in which light emitting sections of light emitting modules are placed and a space in which heat dissipating fins of the light emitting modules are placed, even when the light emitting modules are arranged in a line in a state of closely contacting each other.

Yet another exemplary embodiment of the invention provides an optical semiconductor illuminating apparatus, which can be commonly applied in the form of a single product or plural products to various kinds of illuminating apparatuses.

In accordance with one aspect of the present invention, an optical semiconductor illuminating apparatus includes a heat dissipating base; a light emitting module including at least one semiconductor light emitting device and mounted on a lower surface of the heat dissipating base; and a plurality of heat dissipating fins each including opposite edges protruding from opposite sides of the heat dissipating base and being disposed on an upper side of the heat dissipating base.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

The invention is described more fully hereinafter with reference to the accompanying drawings, in which exemplary embodiments of the invention are illustrated.

Figure 1:
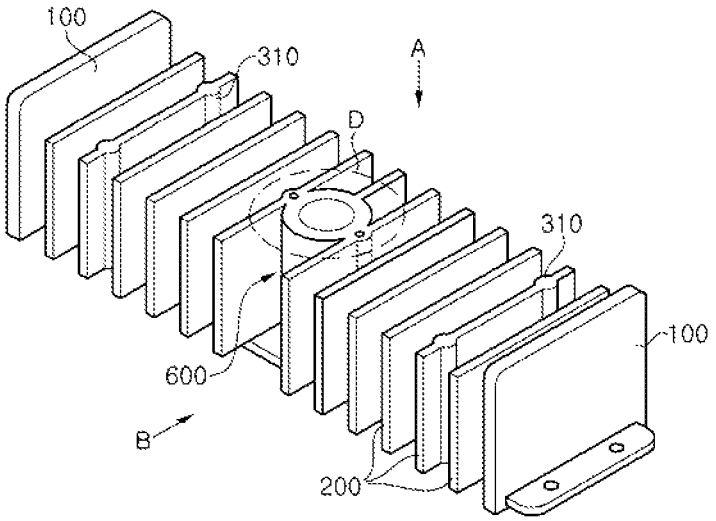
FIG. 1 is a perspective view showing an overall configuration of an optical semiconductor illuminating apparatus according to one exemplary embodiment of the invention.
Figure 2:
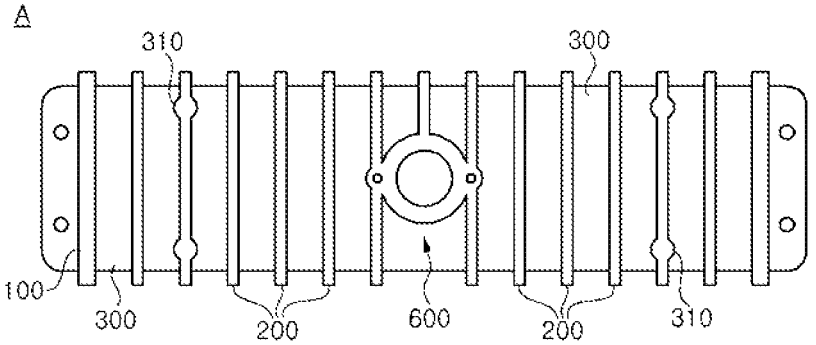
FIG. 2 is a plan view of the optical semiconductor illuminating apparatus when viewed from point A of FIG. 1.
Figure 3:
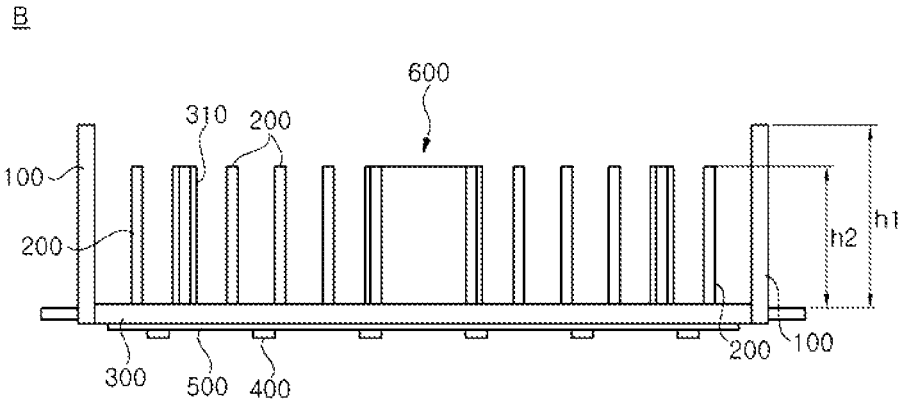
FIG. 3 is a side view of the optical semiconductor illuminating apparatus when viewed from point B of FIG. 1.

FIG. 1 is a perspective view showing an overall configuration of an optical semiconductor illuminating apparatus according to one exemplary embodiment of the invention, FIG. 2 is a plan view of the optical semiconductor illuminating apparatus when viewed from point A of FIG. 1, and FIG. 3 is a side view of the optical semiconductor illuminating apparatus when viewed from point B of FIG. 1.

As used herein, the term 'upper side' and 'lower side' should be understood as relative concepts.

As shown, an optical semiconductor illuminating apparatus according to one exemplary embodiment of the invention includes a light emitting module 500, first and second heat dissipating fins 100, 200, and a connecting section 600 mounted on a heat dissipating base 300.

The heat dissipating base 300 provides an area on which the light emitting module 500, the first and second heat dissipating fins 100, 200 and the connecting section 600 will be placed, and constitutes a heat transfer area for realizing heat dissipation effects in which heat generated from semiconductor light emitting devices 400 of the light emitting module 500 is transferred through the first and second heat dissipating fins 100, 200.

The light emitting module 500 includes a printed circuit board mounted on a lower surface of the heat dissipating base 300 and at least one semiconductor light emitting device 400 mounted on the printed circuit board.

The first heat dissipating fins 100 protrude from opposite ends of an upper surface of the heat dissipating base 300 and form a heat transfer area for realizing heat dissipation capabilities.

The second heat dissipating fins 200 are formed on the upper surface of the heat dissipating base 300, and have a smaller height (h2) from the upper surface of the heat dissipating base 300 than a height (h1) of the first heat dissipating fins 100. The second heat dissipating fans 200 are placed between the first heat dissipating fins 100 and form a heat transfer area for realizing heat dissipation capabilities together with the first heat dissipating fins 100.

A space created by the structure in which the height (h2) of the second heat dissipating fins 200 is less than the height (h1) of the first heat dissipating fins 100, that is, a space between the first heat dissipating fins 100 placed at opposite ends of the heat dissipating base 300 and upper ends of the second heat dissipating fins 200 may be used as a space for mounting various components including a controller 700, as will be described in more detail below.

The connecting section 600 is formed on the upper surface of the heat dissipating base 300. The connecting section 600 can be more or less maintained in a waterproof and airtight state, and provides a passage through which an interconnecting cable (c) electrically connected to the light emitting module 500 (see FIG. 4 and FIG. 5) passes.

In addition, to provide an air flow passage while enhancing heat dissipation capabilities through natural convection or forced convection, opposite edges of each of the first and second heat dissipating fins 100, 200 may protrude from opposite edges of the heat dissipating base 300.

It should be understood that the present invention may also be realized by other exemplary embodiments described below.

The optical semiconductor illuminating apparatus according to the embodiment includes the first and second heat dissipating fins 100, 200 formed on the heat dissipating base 300, on which the light emitting module 500 including a semiconductor light emitting device 400 is mounted. Here, as described above, the heat dissipating base 300 having the first and second heat dissipating fins 100, 200 mounted thereon includes the light emitting module 500.

The optical semiconductor illuminating apparatus according to the embodiment may further include at least one rib 310 extending from the upper surface of the heat dissipating base 300 and connected to the second heat dissipating fin 200.

The rib 310 may act to provide a fastening structure, for example, a thread forming space for coupling to an installation bracket or a support structure (not shown) above the optical semiconductor illuminating apparatus according to the invention.

In other words, the rib 310 is useful in terms of utilization of the space formed by the structure in which the height (h2) of the second heat dissipating fins 200 is less than the height (h1) of the first heat dissipating fins 100, that is, the space defined between the first heat dissipating fins 100 placed at opposite ends of the heat dissipating base 300 and the upper ends of the second heat dissipating fins 200.

Specifically, when a component such as an installation bracket or a support structure is placed in the space defined between the first heat dissipating fins 100 placed at opposite ends of the heat dissipating base 300 and the upper ends of the second heat dissipating fins 200, the component can be secured to the rib 310 through threads which will be formed on an outer surface of the rib 310.

As described above, the connecting section 600 permits an electrical connection to light emitting module 500 while securing a waterproof and hermetic seal, and may be applied to embodiments wherein a ring cover 620 is coupled to a connection housing 610.

Figure 4:
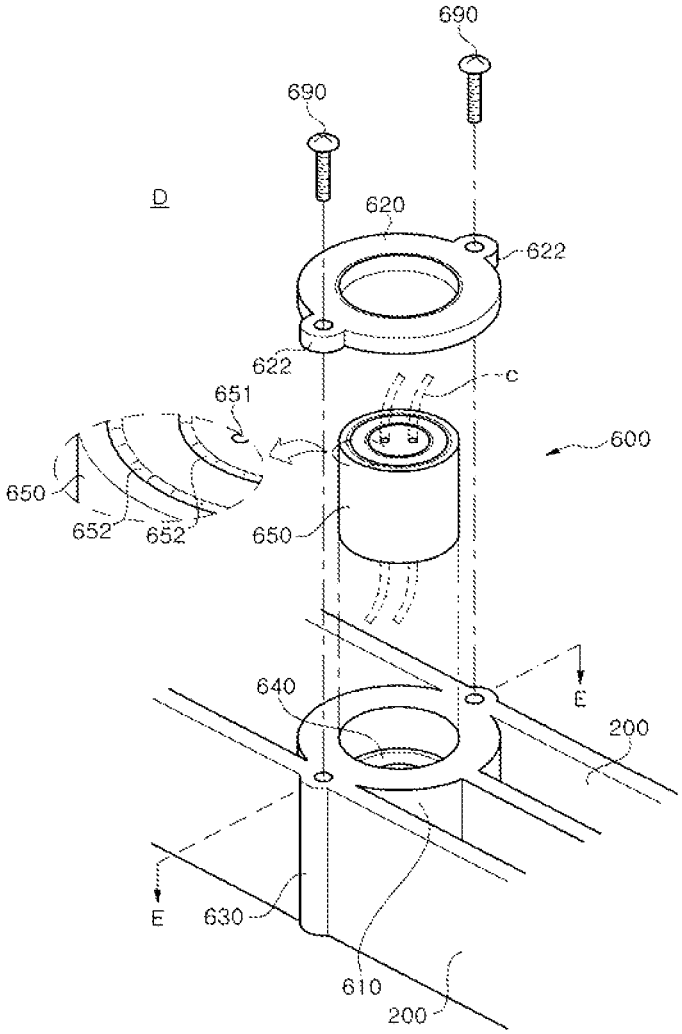
FIG. 4 is an exploded perspective view of Part D of the optical semiconductor illuminating apparatus of FIG. 1.

Referring to FIG. 4, the connection housing 610 defines an internal space communicating with the light emitting module 500 and protrudes from the upper surface of the heat dissipating base 300.

The ring cover 620 is coupled to an open upper side of the connection housing 610 to close the connection housing 610.

Here, the light emitting module 500 is connected to a power supply P (see FIG. 8) via an interconnecting cable (c) which passes through the center of the ring cover 620.

In the connecting section 600, connection ribs 630 of the connection housing 610 are fastened to connection wings 622 of the ring cover 620 by fasteners 690, such as bolts and the like, for coupling between the connection housing 610 and the ring cover 620.

In other words, the connection ribs 630 are formed on both sides of an outer peripheral surface of the connection housing 610 along the outer periphery of the connection housing 610 from the upper surface of the heat dissipating base 300, and are connected to the second heat dissipating fins 200.

Here, the ring cover 620 is coupled to the open upper side of the connection housing 610 and to the upper ends of the connection ribs 630, and the fasteners 690 pass through the connection wings 622 extending from both sides of the ring cover 620 and screwed to the connection ribs 630, so that the connection housing 610 and the ring cover 620 are coupled to each other.

It should be understood that the connecting section 600 may also further include a sealing member 650 mounted on a ring step 640 to maintain a waterproof and hermetic seal.

The ring step 640 is formed at a lower inner surface of the connection housing 610 and communicates with the light emitting module 500. The sealing member 650 is seated on the ring step 640 and is received in the connection housing 610 to maintain a waterproof and hermetic seal.

Specifically, the sealing member 650 is formed of an elastic material such as rubber, synthetic rubber, or synthetic resin, and constitutes an outer surface corresponding to an inner surface of the connection housing 610. The sealing member 650 is press-fitted into the connection housing 610, thereby enabling maintenance of a waterproof and hermetic seal.

Accordingly, the light emitting module 500 is connected to the power supply P via the interconnection wire (c) which passes through a through-hole 651 formed at the center of the sealing member 650.

Further, the sealing member 650 may further include a tight contact rib 652 to improve a waterproof and hermetic seal by further increasing contact force with respect to the ring cover 620.

Figure 5:
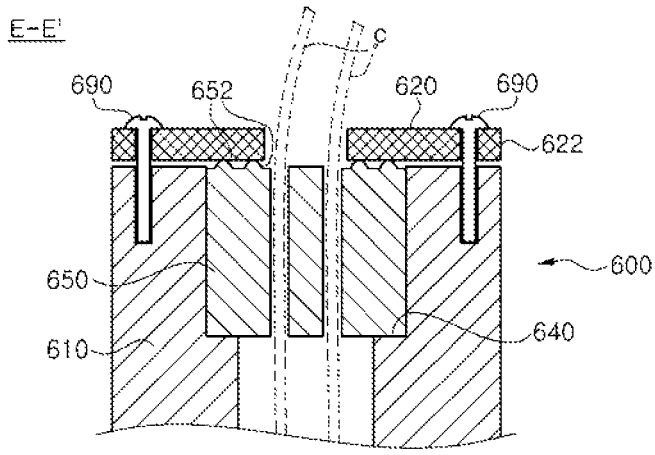
FIG. 5 is a cross-sectional view of line E-E' of FIG. 4.

The sealing member 650 is formed on an upper surface thereof with at least one tight contact rib 652 in a concentric shape, and a lower surface of the ring cover 620 is in contact with the tight contact rib 652 as shown in FIG. 5, thereby maintaining a waterproof and hermetic seal.

In other words, the light emitting module 500 is connected to the power supply P by the interconnection wire (c) which passes through the center of the sealing member 650 and the center of the ring cover 620. Here, as the sealing member 650 having elasticity and placed around the through-hole 651 is compressed by the ring cover 620, the interconnection wire (c) passing through the through-hole 651 is further brought into close contact with the through-hole 651, thereby enabling waterproofing and hermetically sealing the passing direction of the interconnection wire (c).

Thus, the illuminating apparatus according to the embodiment shown in FIGS. 4 and 5 can be applied to many countries throughout the world.

Figure 6:
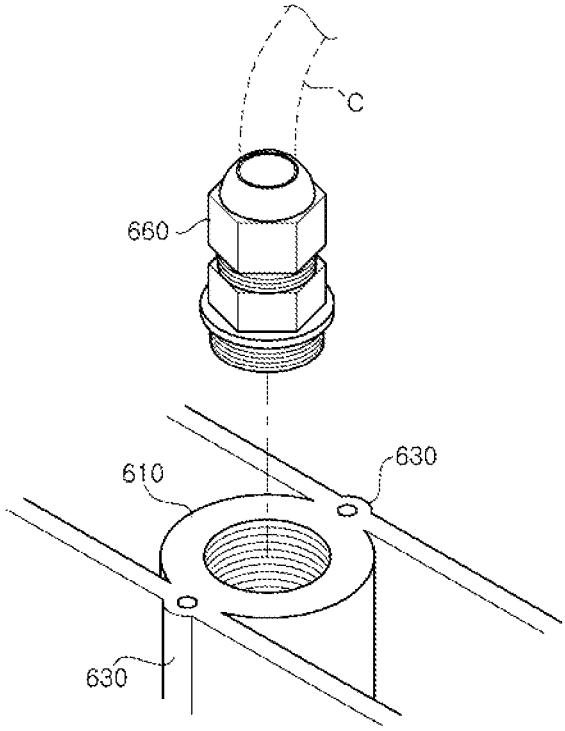
FIG. 6 is a partially exploded perspective view of a connection section of the optical semiconductor illuminating apparatus according to the exemplary embodiment of the invention.
Figure 7:
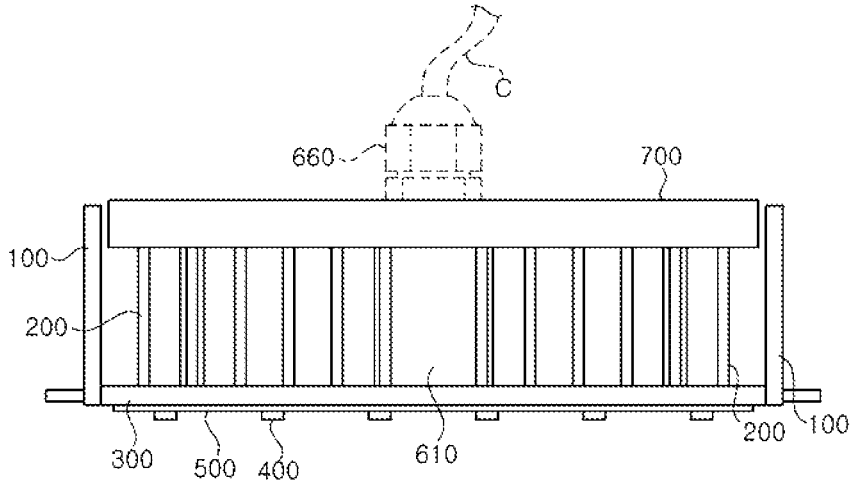
FIG. 7 is a side view showing the overall configuration of the optical semiconductor illuminating apparatus according to the exemplary embodiment of the invention.

On the other hand, some countries do not permit the use of products having a structure in which the interconnection wire (c) is exposed, as shown in FIGS. 4 and 5. Thus, in some exemplary embodiments, the illuminating apparatus may include a cable gland 660 such that a covered interconnection wire (C) can be used to connect the light emitting module to the power supply P, as shown in FIGS. 6 and 7.

Specifically, the grand cable 660 is provided with an O-ring to provide a waterproof and hermetic seal, and is connected to the upper side of the connection housing 610. Thus, the light emitting module 500 is connected to the power supply P by the covered interconnection wire (C) passing through the cable gland 660.

Further, although not shown, the sealing member 650 of FIG. 4 may be seated on the ring step 640 formed inside the connection housing 610 and press-fitted into the connection housing 610, and the cable gland 660 may be coupled to the upper side of the connection housing 610, thereby realizing a dual-stage waterproof and hermetic structure.

Accordingly, the light emitting module 500 may be connected to the power supply P by the covered interconnection wire (C), which passes through the center of the sealing member 650 and the cable gland 660.

In other embodiments, the illuminating apparatus may further include a controller 700 to control operation of each or some of the semiconductor light emitting devices 400, as shown in FIG. 7.

Specifically, the controller 700 is seated on the upper ends of the second heat dissipating fins 200 to be placed between the first heat dissipating fins 100, and is electrically connected to the light emitting module 500 via the connecting section 600.

In other words, as described above, the controller 700 is placed in the space formed by the structure in which the height (h2) of the second heat dissipating fins 200 is less than the height (h1) of the first heat dissipating fins 100, that is, in the space defined between the first heat dissipating fins 100 placed at opposite ends of the heat dissipating base 300 and the upper ends of the second heat dissipating fins 200.

Here, it should be understood that an upper surface of the controller 700 may be higher or coplanar with the upper ends of the first heat dissipating fins 100 according to installation environments in some embodiments.

Here, the cable gland 660 has the covered interconnection wire (C) received therein and connecting the light emitting module 500 to the power supply P through the controller 700, which is seated on the upper ends of the second heat dissipating fins 200 between the first heat dissipating fins 100.

Figure 8:
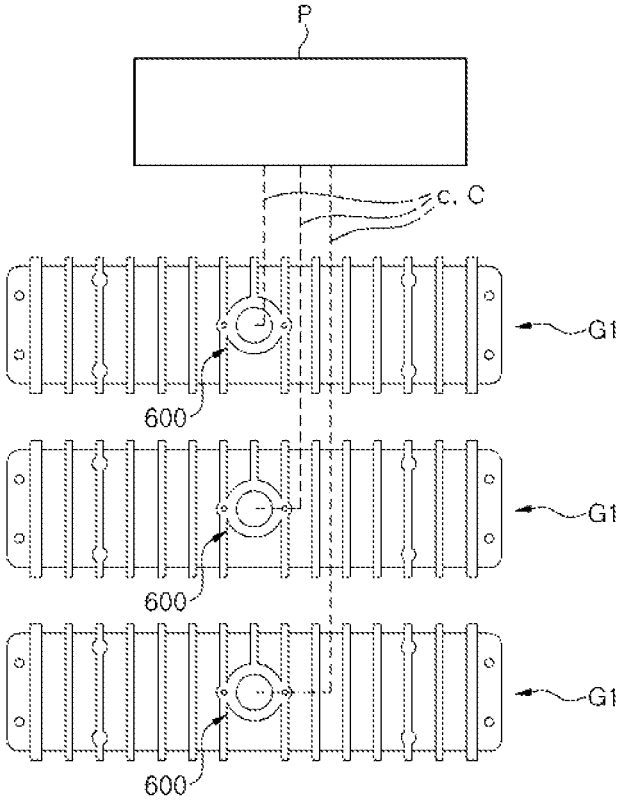
FIG. 8 is a conceptual view of applications of optical semiconductor illuminating apparatuses according to other exemplary embodiments of the invention.

Accordingly, the present invention allows illuminating apparatuses G1, G1, G1 provided as modules to be connected to a single power supply P via an interconnection wire (c) and a covered interconnection wire (C) through a connecting section 600 of each of the illuminating apparatuses G1, G1, G1, as shown in FIG. 8.

Figure 9:
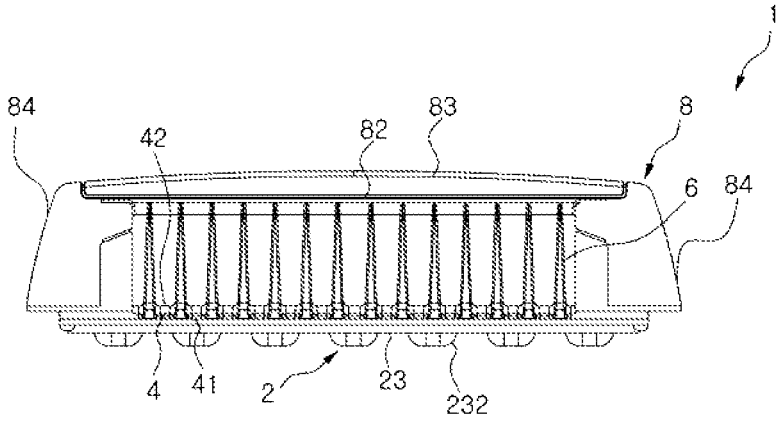
FIG. 9 is a side view of a light emitting module according to one exemplary embodiment of the invention.
Figure 10:
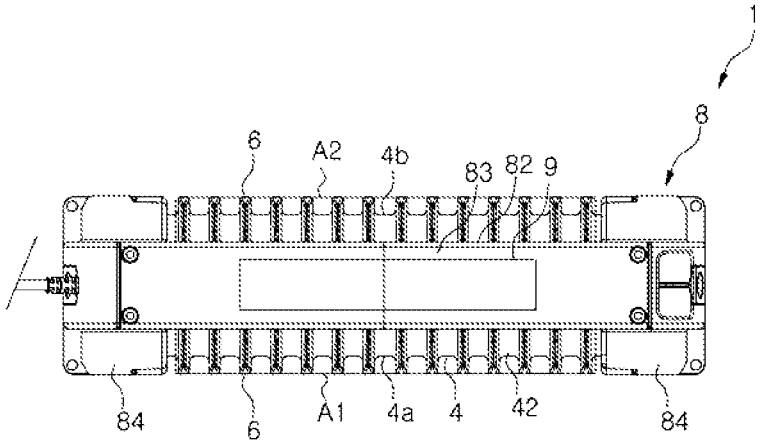
FIG. 10 is a plan view of the light emitting module according to the exemplary embodiment of the invention.
Figure 11:
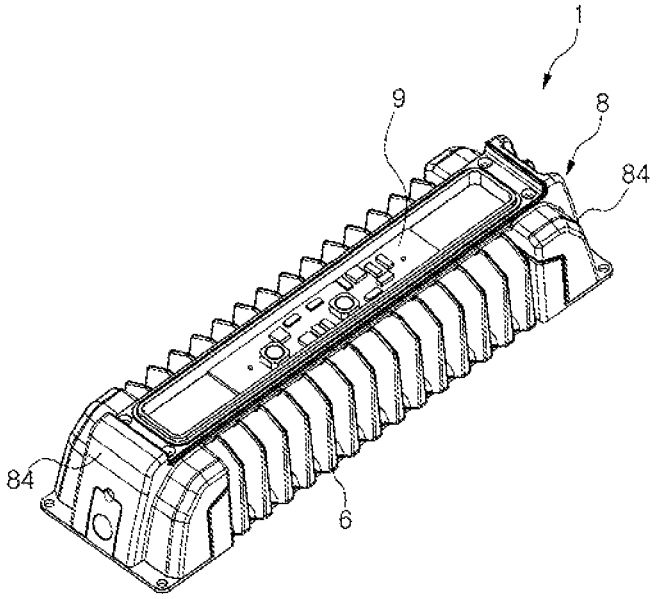
FIG. 11 is a perspective view of the light emitting module according to the exemplary embodiment of the invention, with a cover removed from the light emitting module to show the interior of the light emitting module.
Figure 12:
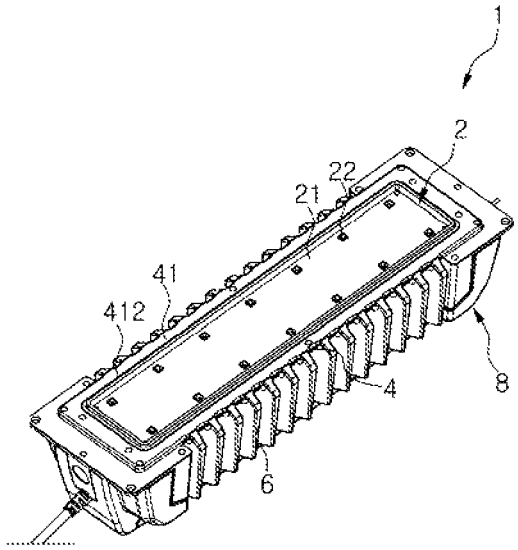
FIG. 12 is a perspective view of the light emitting module according to the exemplary embodiment of the invention, with a cover removed from the light emitting module to show the interior of the light emitting module.

FIG. 9 is a side view of a light emitting module according to one exemplary embodiment of the invention, FIG. 10 is a plan view of the light emitting module according to the exemplary embodiment of the invention, FIG. 11 is a perspective view of the light emitting module according to the exemplary embodiment of the invention, with a cover removed from the light emitting module to show the interior of the light emitting module, and FIG. 12 is a perspective view of the light emitting module according to the exemplary embodiment of the invention, with a cover removed from the light emitting module to show the interior of the light emitting module.

Referring to FIG. 9 to FIG. 12, the light emitting module 1 according to one exemplary embodiment includes a light emitting section 2, a heat dissipating base 4, a plurality of heat dissipating fins 6, and a housing 8.

As clearly shown in FIG. 12, the light emitting section 2 includes a printed circuit board 21 and a plurality of optical semiconductor devices 22 mounted on the printed circuit board 21.

The optical semiconductor device 22 is based on an optical semiconductor, particularly, a light emitting diode (LED), and may have a package structure which receives optical semiconductor chips therein. Alternatively, the optical semiconductor device may have a bare chip structure directly mounted on the printed circuit board 21.

Further, the light emitting section 2 may include an optical cover 23 as shown in FIG. 9. Here, the optical cover 23 is composed of a light-transmitting plastic material and is provided to cover the printed circuit board 21 and the plurality of optical semiconductor devices 22.

Here, the optical cover 23 may include a plurality of lenses 232 corresponding to the plurality of optical semiconductor devices 21.

In this embodiment, each of the lenses 232 may be a light spreading lens, the center of which has a concave structure in order to allow light emitted from the optical semiconductor device 21 to spread broadly while passing therethrough.

The heat dissipating base 4 is made of a substantially rectangular metal plate having good thermal conductivity, and includes a first face 41 and a second face 42 opposite thereto.

The light emitting section 2 is placed on some region of the first face 41 of the heat dissipating base 4.

As best shown in FIG. 12, the first face 41 of the heat dissipating base 4 is formed with a dam section 412 which forms a rectangular receiving section, which receives the printed circuit board 21 on which the optical semiconductor devices 21 are mounted.

Advantageously, the printed circuit board 21 directly contacts the first face 41 of the heat dissipating base 4.

The optical cover 23 (see FIG. 9) of the light emitting section 2 is coupled to the dam section 412, such that the optical semiconductor devices 22 and the printed circuit board 21 are placed under the optical cover 23.

A packing material or a sealing material may be placed between the dam section 412 and the optical cover 23.

As shown in FIGS. 9 and 10, the heat dissipating base 4 is formed with the plurality of heat dissipating fins 6 on the second face 42 thereof.

The plurality of heat dissipating fins 6 may be formed of the same metal as that of the heat dissipating base 4 and may be integrally formed with the heat dissipating base 4, whereby the heat dissipating base 4 and the plurality of heat dissipating fins 6 constitute a single heat sink.

Each of the heat dissipating fins 6 has a plate shape having a predetermined thickness and a predetermined width, and perpendicularly extends from the second face 42 of the heat dissipating base 4.

As best shown in FIG. 10, the heat dissipating fins 6 are arranged to constitute an array in the longitudinal direction.

One side of the array of the heat dissipating fins 6 intersects a first edge 4*a* of the heat dissipating base 4 to form a first intersection area A1, and the other side of the array of the heat dissipating fins 6 intersects a second edge 4*b* of the heat dissipating base 4 to form a second intersection area A2.

In FIG. 10, for convenience of illustration, dash dot-dot line blocks represent the first and second intersection areas, and are indicated by A1 and A2 which denote the first and second intersection areas.

Note that the first and second intersection areas A1, A2 are defined in order to distinguish them from a central region on which a board box described below will be placed.

Each of the heat dissipating fins 6 perpendicularly intersects the first and second edges 4*a*, 4*b* of the heat dissipating base 4, which are opposite to each other, and extend from an inner side of the heat dissipating base 4 to an outside thereof.

Thus, the array of the heat dissipating fins 6 protrudes from the heat dissipating base 4 beyond the first and second edges 4*a*, 4*b* of the heat dissipating base 4.

Advantageously, the heat dissipating fins 6 extend such that both ends of each of the heat dissipating fins are placed near the first and second edges of the heat dissipating base 4, respectively.

With the configuration as described above, air flow passages between the heat dissipating fins 6 are open towards the light emitting section 2 without being blocked by the heat dissipating base 4, whereby air flow can be efficiently achieved between the space for placing the heating dissipating fins 6 and the space for placing the light emitting section 2 on the heat dissipating base 4.

The housing 8 is formed together with the heat dissipating fins 6 on the second face 42 of the heat dissipating base 4.

Thus, the heat dissipating fins 6 and the housing 8 are present together on the second face 42 of the heat dissipating base 4.

The housing 8 may be formed by, for example, injection molding of a plastic material.

The housing 8 may be formed by directly injection-molding a plastic material into a heat sink structure including the heat dissipating fins 6 and the heat dissipating base 4. Alternatively, an injection molded housing 8 may be fastened to the heat sink structure.

As best shown in FIGS. 10 and 11, the housing 8 includes a board box 82 on which a drive circuit board 9 is mounted, and a pair of end sections 84, 84 connected to opposite ends of the board box 82, respectively.

On the second face 42 of the heat dissipating base 4, the board box 82 has a concave shape to receive the drive circuit board 9 and is placed between the first intersection area A1 and the second intersection area A2, that is, at the central region of the second face.

In addition, the box cover 83 covers the board box 82 which receives the drive circuit board 9 therein.

Here, the board box 82 is formed to adjoin leading ends of the heat dissipating fins 6, whereby an air flow space is present between the heat dissipating base 4 and the board box 82.

Each of the pair of end sections 84, 84 is formed outside either end of the array of the heat dissipating fins 6 at either end of the board box 82 to cover either end of the array of the heat dissipating fins 6.

Each of the pair of end sections 84, 84 is formed with an inlet port through which a power cable is introduced into the board box 82 and with an outlet port through which the power cable is withdrawn from the board box 82.

The drive circuit board 9 mounted on the board box 82 of the light emitting module 1 converts constant voltage into constant current to allow the optical semiconductor device 1 within the corresponding light emitting module 1 to be driven by the constant current, and enables the use of a general power supply instead of a switching mode power supply (SMPS), which has a constant current conversion function.

Typically, SMPSs are larger in volume than general power supplies and thus are known a limiting factor in size reduction of an illuminating apparatus into a compact structure.

The light emitting module 1 includes the drive circuit board 9 which converts constant voltage into constant current, and the inlet and outlet ports for the power cable (particularly, DC power cable) connected to the drive circuit board 9, and enables individual connection to a power supply, connection to the power supply in a state of being connected in series to other light emitting modules, and connection to the power supply in a state of being connected in parallel to other light emitting modules, thereby improving compatibility of the light emitting module 1.

Figure 13:
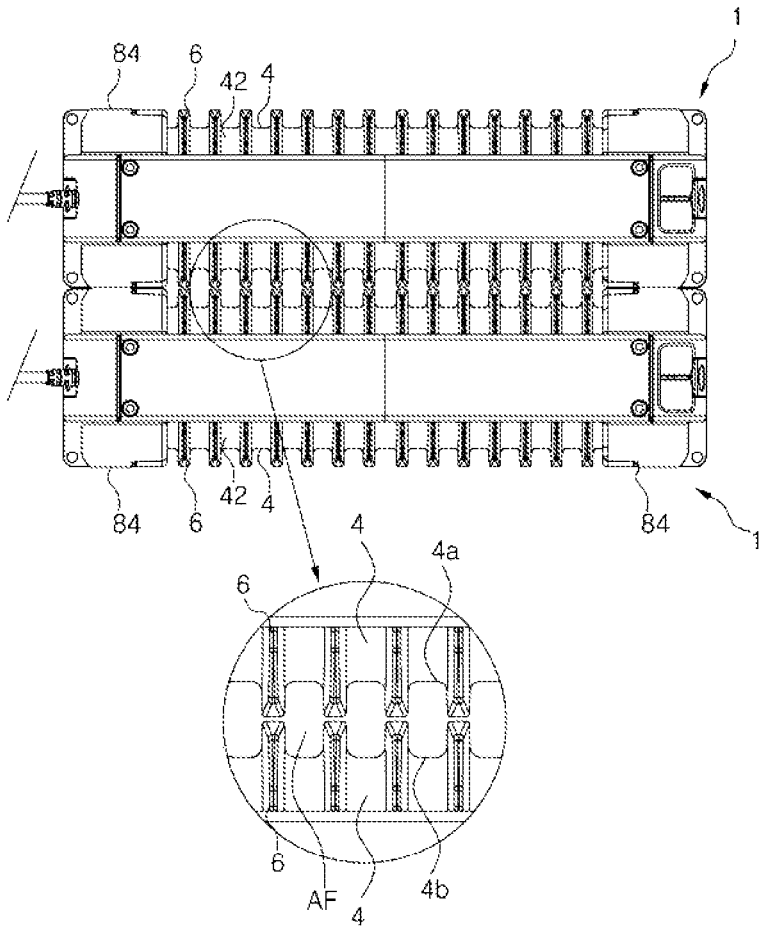
FIG. 13 is a plan view of two light emitting modules arranged parallel to each other in an optical semiconductor illuminating apparatus according to one exemplary embodiment of the invention.
Figure 14:
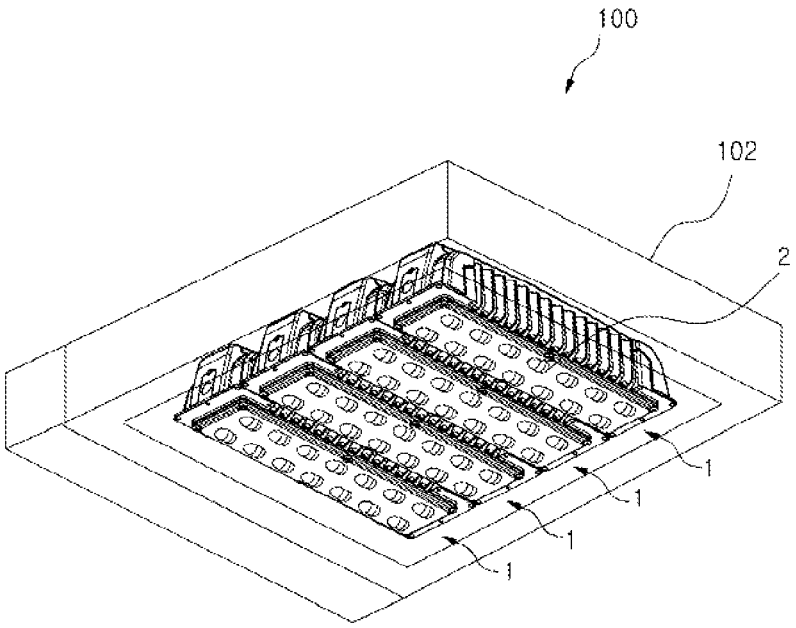
FIG. 14 is a perspective view of a plurality of light emitting modules arranged parallel to each other in an optical semiconductor illuminating apparatus according to one exemplary embodiment of the invention.
Figure 15:
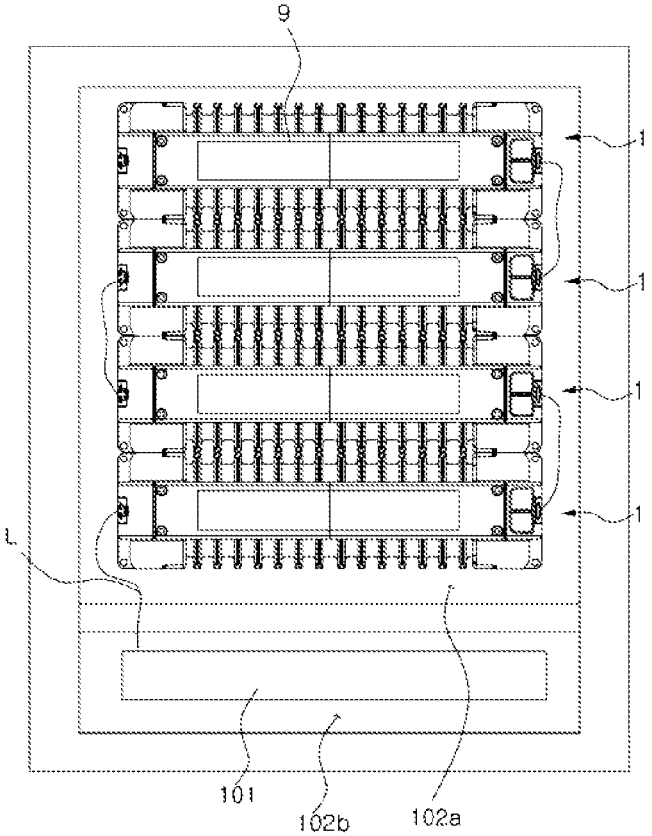
FIG. 15 is a plan view of the plurality of light emitting modules arranged parallel to each other in the optical semiconductor illuminating apparatus according to the exemplary embodiment of the invention.

FIG. 13 to FIG. 15 show illuminating apparatuses which include a plurality of light emitting modules as described above. Specifically, FIG. 13 is a plan view of two light emitting modules arranged parallel to each other in an optical semiconductor illuminating apparatus according to one exemplary embodiment of the invention, FIG. 14 is a perspective view of a plurality of light emitting modules arranged parallel to each other in an optical semiconductor illuminating apparatus according to one exemplary embodiment of the invention, and FIG. 15 is a plan view of the plurality of light emitting modules arranged parallel to each other in the optical semiconductor illuminating apparatus according to the exemplary embodiment of the invention.

Referring first to FIG. 13, first and second light emitting modules 1, 1 are arranged parallel to each other.

As described above, each of the first and second light emitting modules 1, 1 includes the heat dissipating base 4 and the plurality of heat dissipating fins 6 as components of a heat sink.

In each of the first and second light emitting modules 1, 1, the heat dissipating fins 6 adjoin each other while protruding from the corresponding heat dissipating base 4 of the light emitting module 1 beyond the first and second edges 4*a*, 4*b* of the heat dissipating base 4.

Accordingly, a plurality of air flow passages AF is formed between the first light emitting module 1 and the second light emitting module adjoining each other in parallel. This allows efficient air flow between the space having the heat dissipating fins 6 of the first and second light emitting modules 1, 1 and the space having the light emitting sections of the first and second light emitting modules 1, 1, thereby significantly improving heat dissipation efficiency.

As described above, since the air flow passages are secured between the light emitting modules 1 adjoining each other to be parallel to each other, heat dissipation efficiency of the light emitting modules 1 is not significantly deteriorated even when the plurality of light emitting modules 1 is arranged parallel to each other to adjoin each other inside the illuminating apparatus 100, as shown in FIGS. 14 and 15.

Referring to FIGS. 14 and 15, the illuminating apparatus 100 includes an external housing 102 (indicated by an imaginary line) open at a lower side thereof, and the plurality of light emitting modules 1 is accommodated within the external housing 102 such that the light emitting sections 2 face the open lower side of the external housing 102.

Particularly, referring to FIG. 15, the interior of the external housing 102 is divided into a first space 102*a* in which the plurality of light emitting modules 1 is placed and a second space 102*b* in which a power supply 101 is placed.

The power supply 101 does not need to have a constant voltage-to-constant current conversion function since each of the light emitting modules 1 includes the drive circuit board 9 having the constant voltage-to-constant current conversion function.

As described above, each of the light emitting modules 1 includes the inlet and outlet ports for the power cable L connected to the corresponding drive circuit board 9. Thus, as shown in FIG. 15, the plurality of light emitting modules 1 may be connected in series in such a way that a power line exiting from one light emitting module, that is, the first light emitting module 1, through the outlet port of the one light emitting module is introduced into another light emitting module, that is, the second light emitting module 1, through the inlet port of the other light emitting module.

This configuration permits elimination of a complex branched structure of a power line which is required to connect the plurality of light emitting modules 1 in parallel.

Parallel connection between the light emitting modules 1 may be achieved using only one of two ports.

In the above, the illuminating apparatus including the light emitting modules arranged in parallel therein has been described.

Figure 16:
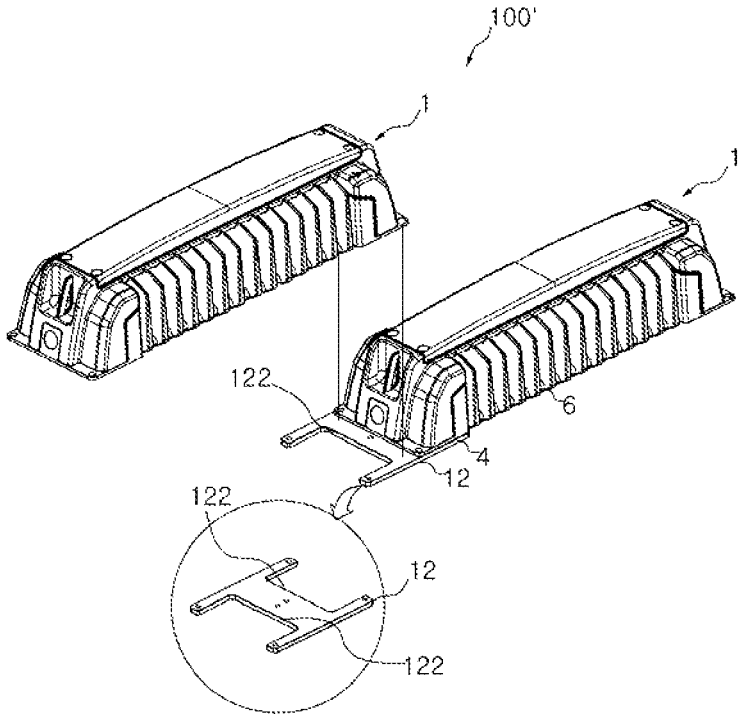
FIG. 16 is an exploded perspective view of one example of an illuminating apparatus including a plurality of light emitting modules connected to each other in a longitudinal direction.
Figure 17:
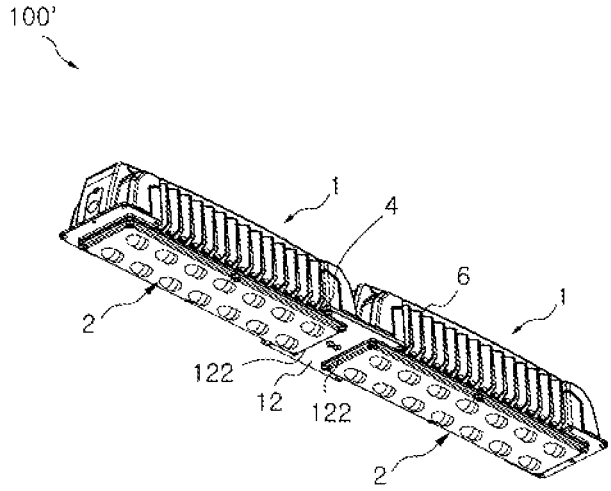
FIG. 17 is a perspective view of the plurality of light emitting modules of FIG. 16 connected to each other in a longitudinal direction.

FIGS. 16 and 17 show an illuminating apparatus including a plurality of light emitting modules connected to each other in a longitudinal direction, in which the light emitting modules may be the same as those described above.

Referring to FIGS. 16 and 17, an illuminating apparatus 100' may be realized by longitudinally connecting light emitting modules 1 as described above.

Here, one light emitting module 1, that is, a first light emitting module 1, may be linearly aligned with another light emitting module, that is, a second light emitting module 1, to be adjacent each other in an end-to-end relationship.

Further, the illuminating apparatus 100' is provided with a connecting member 12 which connects two adjacent light emitting modules 1, 1 to each other in the end-to-end relationship to be separable from each other.

The connecting member 12 may be detachably coupled to the heat dissipating base of the light emitting module 1 by, for example, a bolt or a screw fastener.

Furthermore, the connecting member 12 may be a plate piece which is placed on the heat dissipating base 4 near one end of the array of the heat dissipating fins 6 and fastened thereto by the fastener.

In this embodiment, the connecting member 12 is fastened to the heat dissipating base 4 and connects one side of the light emitting module 1 to the other side of the other light emitting module 1, which faces the light emitting module in the end-to-end relationship.

Here, a pair of grooves 122 is formed at both ends of the connecting member 12 to prevent the connecting member 12 from shielding the light emitting sections of the two adjacent light emitting modules 1.

Figure 18:
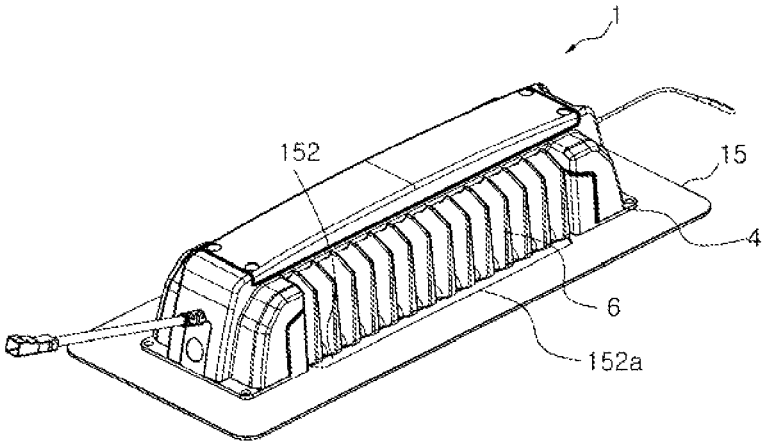
FIG. 18 is a perspective view of one embodiment of a connecting member for applying a light emitting module according to the invention to various kinds of illuminating apparatuses for various purposes.
Figure 19:
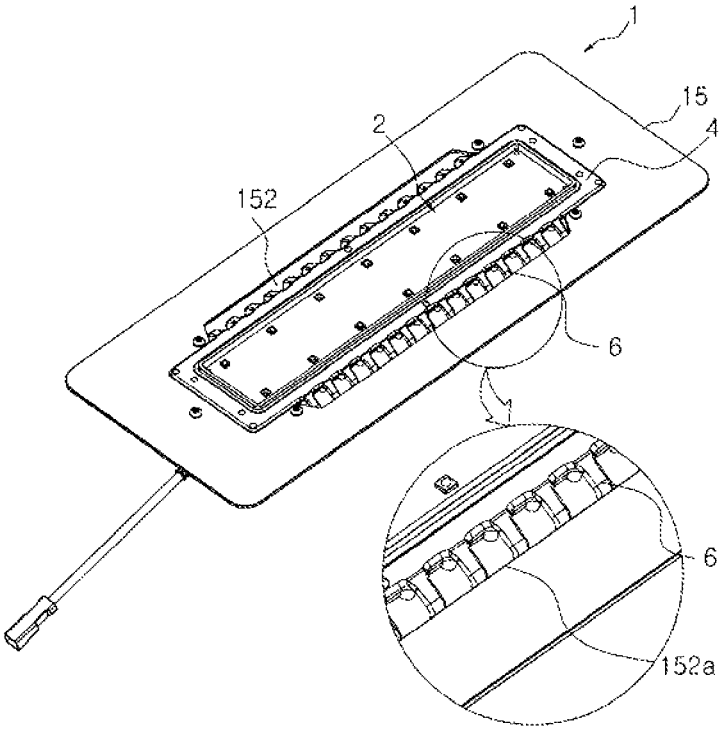
FIG. 19 is a perspective view of the light emitting module of FIG. 18, showing a light emitting section for various purposes.

FIG. 18 is a perspective view of one example of the connecting member for applying a light emitting module according to the invention to various purposes or various kinds of illuminating apparatuses, and FIG. 19 is a perspective view of the light emitting module of FIG. 18, showing a light emitting section.

The connecting member 12 (see FIGS. 16 and 17) for longitudinally connecting the plurality of light emitting modules 1 to each other has been described above.

In order to apply one light emitting module 1 to various kinds of illuminating apparatuses, there is a need for a connecting member suitable for this purpose.

The connecting member 12 may connect the light emitting module 1 to a fixture suited for functions of a certain illuminating apparatus.

Examples of the fixture may include a bracket used for flood lamps or landscape lamps, a pendant used for parking lamps, and the like.

In addition, other types of fixtures may be detachably coupled to the light emitting module 1 by the connecting member fastened to the heat dissipating base 4.

Referring to FIGS. 18 and 19, a connecting plate 15, which is formed of a metallic material, is provided at a center thereof with an opening 152.

With some area of the opening 152 overlapping the heat dissipating base, the connecting plate 15 is fastened to the heat dissipating base 4 by, for example, a bolt or a screw fastener.

The connecting plate 15 is coupled to a certain fixture by another fastener. According to the function, shape and structure of the fixture, the light emitting module 1 may be applied to various kinds of illuminating apparatuses for various purposes.

On the other hand, the opening 152 is formed at an inner side thereof with recesses 152*a* through which the heat dissipating fins 6 of the light emitting module 1 are exposed towards the light emitting section 2 of the light emitting module 1.

The recesses 152*a* allow the space for the heat dissipating fins 6 at one side of the connecting plate 15 to be open with respect to a space at the opposite side thereof.

In addition, the recesses 152*a* allow the air flow passages formed between the heat dissipating fins 6 protruding from the heat dissipating base 4 to be open instead of being blocked by the connecting plate 15.

Figure 20:
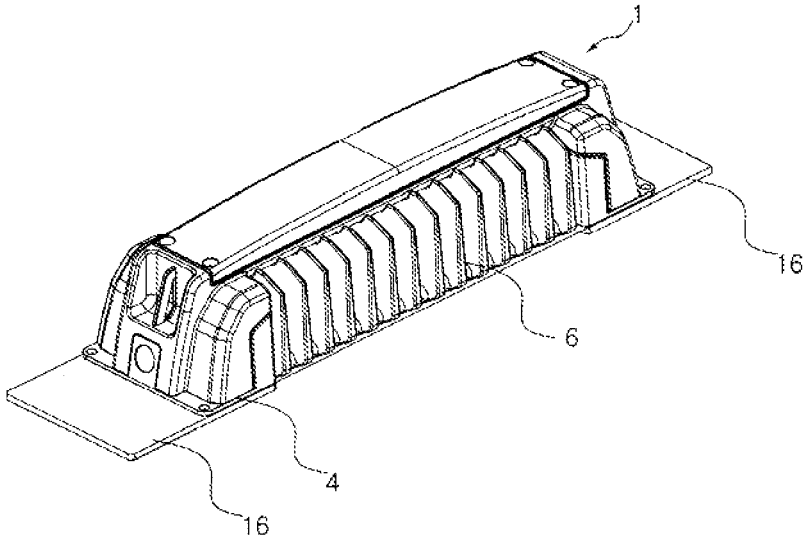
FIG. 20 is a perspective view of another embodiment of a connecting member for applying a light emitting module according to the invention to various kinds of illuminating apparatuses for various purposes.

FIG. 20 is a perspective view of another embodiment of a connecting member for applying a light emitting module according to the invention to various kinds of illuminating apparatuses for various purposes.

Referring to FIG. 20, a connecting member according to another embodiment is composed of a pair of plate pieces 16, 16, which connect the light emitting module 1 to a fixture and is fastened to the heat dissipating base at both ends of the array of the heat dissipating fins 6 in a state of overlapping the heat dissipating base 4.

Although not shown in the drawings, the plate pieces 16, 16 are formed with fastening holes through which screws or bolts are coupled to the fixture to couple the plate pieces to the fixture.

Here, since the pieces 16, 16 are placed near both ends of the heat dissipating base 4 free from the heat dissipating fins 6, the air flow passages between the heat dissipating fins 6 are not blocked by the pieces 16, 16.

As described above, it can be understood that the optical semiconductor illuminating apparatus according to the exemplary embodiments of the invention has a fundamental idea of enabling various types of interconnection through a single module according to country, while improving heat dissipation capabilities and maintaining air-tightness.

According to exemplary embodiments of the invention, each of first and second heat dissipating fins have opposite edges protruding from opposite sides of the heat dissipating base to permit air flow therethrough, thereby providing fundamental heat dissipation capabilities.

In addition, the exemplary embodiments of the invention provide various types of connection members, such as a ring cover, a cable gland, and the like, thereby providing a fundamental waterproofing and hermetically sealing functions.

Further, the embodiments of the invention provide various types of connection members, such as a ring cover, a cable gland, and the like, such that the ring cover or the cable gland can be selectively mounted on a single module, thereby enabling various interconnections according to country.

Further, according to the embodiments of the invention, the illuminating apparatus includes first heat dissipating fins, which are higher than a plurality of second heat dissipating fins on the heat dissipating base, to increase a fundamental heat transfer area, such that components such as a controller and a fastening bracket can be placed in a space created by the structure of the first and second heat dissipating fins having different heights, thereby facilitating accurate assembly and positioning of components while providing a sufficient space for mounting of the components.

Furthermore, the illuminating apparatus according to the embodiments of the invention includes an air flow passage, which directly connects a space for the heat dissipation fins to a space for the light emitting section on the heat dissipating base of the heat sink, thereby significantly improving heat dissipation efficiency.

Furthermore, according to the embodiments of the invention, the illuminating apparatus can secure a plurality of air flow passages between a space for the light emitting sections of light emitting modules and a space for the heat dissipating fins of the light emitting modules, even when the light emitting modules are arranged in a line while closely contacting each other.

Furthermore, according to the embodiments of the invention, the light emitting module may be commonly applied in the form of a single product or plural products to various kinds of illuminating apparatuses.

Although the present invention has been illustrated with reference to some embodiments in conjunction of the accompanying drawings, it should be understood that the embodiments are provided for illustration only and are not intended to limit the scope of the invention, and that various modifications and variations can be made by a person having ordinary knowledge in the art without departing from the spirit and scope of the invention. Therefore, the scope of the present invention should be limited only by the attached claims and equivalents thereof.

What is claimed is:

1. An optical semiconductor illuminating apparatus comprising:

a heat dissipating base;

a light emitting module comprising at least one semiconductor light emitting device and mounted on a lower side of the heat dissipating base;

heat dissipating fins each having opposite edges protruding from opposite sides of the heat dissipating base and being mounted on an upper surface of the heat dissipating base; and a connecting section formed on the upper surface of the heat dissipating base and receiving an interconnection wire penetrating therethrough to be electrically connected to the light emitting module.

2. The optical semiconductor illuminating apparatus according to claim 1, wherein the heat dissipating fins comprise:

first heat dissipating fins formed at opposite ends of the upper surface of the heat dissipating base; and second heat dissipating fins formed on the upper surface of the heat dissipating base and placed between the first heat dissipating fins, the second heat dissipating fins having a smaller height than the first heat dissipating fins on the heat dissipating base.

3. The optical semiconductor illuminating apparatus according to claim 1, wherein the connecting section comprises:

a connection housing defining an interior space communicating with the light emitting module and protruding from the upper surface of the heat dissipating base; and a ring cover coupled to an open upper side of the connection housing.

4. The optical semiconductor illuminating apparatus according to claim 3, wherein the light emitting module is connected to a power supply via the interconnection wire passing through a center of the ring cover.

5. The optical semiconductor illuminating apparatus according to claim 1, wherein the connecting section comprises:

a connection housing defining an interior space communicating with the light emitting module and protruding from the upper surface of the heat dissipating base, connection ribs formed along an outer peripheral surface of the connection housing from the upper surface of the heat dissipating base and connected to the second heat dissipating fins, and a ring cover coupled to an open upper side of the connection housing and to an upper end of the connection rib.

6. The optical semiconductor illuminating apparatus according to claim 5, wherein the light emitting module is connected to a power supply via the interconnection wire passing through a center of the ring cover.

7. The optical semiconductor illuminating apparatus according to claim 1, wherein the connecting section comprises:

a connection housing defining an interior space communicating with the light emitting module and protruding from the upper surface of the heat dissipating base, a ring step formed at a lower inner surface of the connection housing and communicating with the light emitting module, and a sealing member seated on the ring step and received in the connection housing.

8. The optical semiconductor illuminating apparatus according to claim 7, wherein the light emitting module is connected to a power supply via the interconnection wire passing through a center of the sealing member.

9. The optical semiconductor illuminating apparatus according to claim 1, wherein the connecting section comprises:

a connection housing defining an interior space communicating with the light emitting module and protruding from the upper surface of the heat dissipating base, a sealing member received in the connection housing, at least one tight contact rib formed in a concentric shape on an upper surface of the sealing member, and a ring cover coupled to an open upper side of the connection housing and having a lower surface contacting the tight contact rib.

10. The optical semiconductor illuminating apparatus according to claim 9, wherein the light emitting module is connected to a power supply via the interconnection wire passing through a center of the sealing member and a center of the ring cover.

11. The optical semiconductor illuminating apparatus according to claim 1, wherein the connecting section comprises:

a connection housing defining an interior space communicating with the light emitting module and protruding from the upper surface of the heat dissipating base, and a cable gland connected to an upper side of the connection housing.

12. The optical semiconductor illuminating apparatus according to claim 11, wherein the light emitting module is connected to a power supply via the interconnection wire passing through the cable gland.

13. The optical semiconductor illuminating apparatus according to claim 1, wherein the connecting section comprises:

a connection housing defining an interior space communicating with the light emitting module and protruding from the upper surface of the heat dissipating base, a ring step formed at a lower inner surface of the connection housing and communicating with the light emitting module, a sealing member seated on the ring step and received in the connection housing, and a cable gland connected to an upper side of the connection housing.

14. The optical semiconductor illuminating apparatus according to claim 13, wherein the light emitting module is connected to a power supply via the interconnection wire passing through a center of the sealing member and the cable gland.

15. An optical semiconductor illuminating apparatus comprising:

a heat dissipating base;

a light emitting module comprising at least one semiconductor light emitting device and mounted on a lower side of the heat dissipating base;

first heat dissipating fins formed at opposite ends of the upper surface of the heat dissipating base and comprising opposite edges protruding from opposite sides of the heat dissipating base;

second heat dissipating fins comprising opposite edges protruding from the opposite sides of the heat dissipating base, and being placed between the first heat dissipating fins on the upper surface of the heat dissipating base, the second heat dissipating fins having a smaller height than the first heat dissipating fins on the upper surface of the heat dissipating base; and a connecting section formed on the upper surface of the heat dissipating base and receiving an interconnection wire penetrating therethrough to be electrically connected to the light emitting module.

16. The optical semiconductor illuminating apparatus according to claim 15, wherein the connecting section comprises:

a connection housing defining an interior space communicating with the light emitting module and protruding from the upper surface of the heat dissipating base, and a cable gland connected to an upper side of the connection housing, wherein a controller is seated on upper ends of the second heat dissipating fins to be placed between the first heat dissipating fins.

17. The optical semiconductor illuminating apparatus according to claim 16, wherein the cable gland comprises a covered interconnection wire penetrating therethrough and connecting the light emitting module to a power supply through the controller seated on the upper ends of the second heat dissipating fins to be placed between the first heat dissipating fins.

18. The optical semiconductor illuminating apparatus according to claim 16, further comprising:

at least one rib protruding from the upper surface of the heat dissipating base and connected to the second heat dissipating fin.

19. The optical semiconductor illuminating apparatus according to claim 16, further comprising:

a controller seated on the upper ends of the second heat dissipating fins to be placed between the first heat dissipating fins, the controller being electrically connected to the light emitting module through the connecting section and having an upper surface coplanar with or higher than upper surfaces of the first heat dissipating fins.

* * * * *